United States Patent [19]

Miro

[11] 4,232,769

[45] Nov. 11, 1980

[54] RACKING MECHANISM FOR BOBBIN MACHINE

[75] Inventor: Juan C. Miró, Santa Maria de Barbara, Spain

[73] Assignee: Industria Espanola de Manufacturas Especiales, S.A., Barcelona, Spain

[21] Appl. No.: 869,033

[22] Filed: Jan. 6, 1978

[30] Foreign Application Priority Data

Jan. 8, 1977 [ES] Spain ..... 454.896

[51] Int. Cl.[2] ..... F16D 67/00; F16H 57/10

[52] U.S. Cl. ..... 192/4 R; 74/777

[58] Field of Search ..... 192/4 R; 74/777

[56] References Cited

U.S. PATENT DOCUMENTS

| | | | |
|---|---|---|---|
| 838,655 | 12/1906 | Sharp | 74/777 |
| 1,963,308 | 6/1934 | Molinelli | 74/777 X |
| 3,664,471 | 5/1972 | Seidlitz | 192/4 R |
| 4,002,088 | 1/1977 | Alsch | 74/777 |

FOREIGN PATENT DOCUMENTS

| | | | |
|---|---|---|---|
| 381759 | 6/1932 | United Kingdom | 74/777 |

*Primary Examiner*—George H. Krizmanich
*Attorney, Agent, or Firm*—Michael J. Striker

[57] ABSTRACT

The bobbins in a jacquard-type lace-making machine are displaceable by means of mechanisms each constituted as an output member carrying one or two bobbins, a transmission member and a continuously rotating drive member. The drive and output members are formed with respective bevel gears centered on the axis of the device and the transmission member carries at least one bevel gear rotatable about an axis transverse to the rotation axis for the mechanism and meshing with both of the gears so that the output gear can rotate in a direction opposite that of the drive gear. An operating shaft carries a pair of operating arms and is displaceable between a stopping position in which the one arm arrests the output member while the other arm allows the transmission member to rotate and a racking position in which the one arm allows the output member to rotate whereas the other arm arrests the transmission member. A cam may be provided on the drive member or on the output member for forceably returning the operator to the stopping position after 180° displacement of the output member.

12 Claims, 12 Drawing Figures

RACKING MECHANISM FOR BOBBIN MACHINE

BACKGROUND OF THE INVENTION

The present invention relates to a mechanism for racking spindles in a bobbin machine. More particularly this invention concerns such a mechanism usable in a jacquard-type loom or machine.

In a jacquard-type machine it is frequently necessary to displace a bobbin or a bobbin-control element through 180° relative to a respective axis. Such angular shifting is necessary for a patterning of the fabric or lace produced by the machine.

In typical such devices an axially effective clutch mechanism is provided between each output member carrying the respective spindle and a continuously rotating drive member. The clutch mechanism is operated by means of a control rod or cable connected to the jacquard control mechanism. Each time the control rod is displaced the clutch is effective to rotate the respective output member through 180°.

Such devices are relatively clumsy in operation and frequently malfunction. A typical difficulty is that they become hung up, that is once the clutch is engaged it stays engaged. Another difficulty is that the output member is not securely held when in the stopped position so that some shifting is possible with corresponding deleterious effects on the product.

SUMMARY OF THE INVENTION

It is an object of the present invention to provide an improved racking mechanism.

Another object is to provide such a mechanism which is mechanically sturdy, which operates very accurately, and which is nonetheless of simple construction so that it can be produced at low cost and will have a long service life.

These objects are attained according to this invention principally by forming the mechanism of three main units, namely an output unit having an output member for spindle racking having an output spider bevel gear, a transmission unit having a transmission member provided with a set of idler bevel pinions, and an input or drive unit having a continuously driven drive spur gear on which is carried another spider bevel pinion. The transmission and output members are provided with respective recesses or formations which cooperate with swinging stops carried on a shaft extending adjacent the drive rotation axis for the three units. Operator means can displace the arms between a position with one of the arms engaging the output member and preventing its rotation and the other arm spaced from the transmission member and permitting its rotation to a racking position in which the one arm is free of the output member and allows it to rotate whereas the other arm engages the transmission member and prevents it from rotating.

According to another feature of this invention safety means in the form of a release cam is provided which automatically displaces the two above-mentioned arms back into the stopping position after a rotation of the drive gear corresponding to 180° of rotation of the output member. A control shaft from the jacquard operating mechanism is effective to displace the shaft carrying the operator arms from the stopping to the racking position, whereas a spring operatively engaged with these arms is effective to urge them normally into the stopping position.

According to this invention the output member for the spindle is formed by a typical sinker and a cam or disk provided with two diametrically opposite recesses. In addition this unit has a neck formed at one end as the respective spider bevel pinion. The entire output member has a central throughgoing bore allowing it to be mounted in rotatable fashion over a fixed support shaft.

The transmission member according to this invention is constituted by a tubular body of cruciform section at one end and having a plurality of angularly equispaced recesses constituting stop formations engageable with the transmission arm of the operator means. Inside this transmission member there is provided the pair of idler pinions which are carried on a support block having a central throughgoing hole for its mounting over the general fixed support shaft.

According to another feature of this invention the drive member or gear comprises a cylindrical pinion integrally formed with the drive spider bevel pinion. Between these two parts of the drive gear is provided with the release cam. The entire drive gear is provided with a throughgoing hole through which passes the main support shaft.

The one arm of the operator means is engageable only in the recess of the output member and the other arm which is axially spaced from the output arm is only engageable in the recesses of the transmission member. Since the transmission and output members normally rotate in opposite directions the two arms extend tangentially oppositely relative to the drive axis of the mechanism with each arm extending into the respective rotation direction for the respective member.

The operator shaft carrying the double-branched unitary anchor element having the two above-mentioned arms is provided in turn with a further arm or pawl which is engageable with the release cam of the drive gear.

The two arms are angularly separated in such a manner that if the one arm is brought into the respective recesses the other arm will automatically be displaced out of its respective recesses, with only a very minor angular displacement of the operator shaft. Thus when displaced through only a small distance, or urged toward displacement through a small distance, the device automatically switches from the stopping to the racking position, and thereafter if tension on it is released it will automatically be shifted back into the stopping position. Normally the control rod from the jacquard mechanism need only exert a momentary push or pull on the operator arms for the desired racking motion which is constituted by a 180° displacement of the output member.

The operator shaft carries an arm at the end of which is engaged the tensioning spring and at which end is also connected the rod from the jacquard contol mechanism. The tensioning spring normally urges the racking device into its stopping position, functioning along with the return or release cam described above.

The novel features which are considered as characteristic for the invention are set forth in particular in the appended claims. The invention itself, however, both as to its construction and its method of operation, together with additional objects and advantages thereof, will be best understood from the following description of a specific embodiment when read in connection with the accompanying drawings.

DESCRIPTION OF A PREFERRED EMBODIMENT

Figure 1:
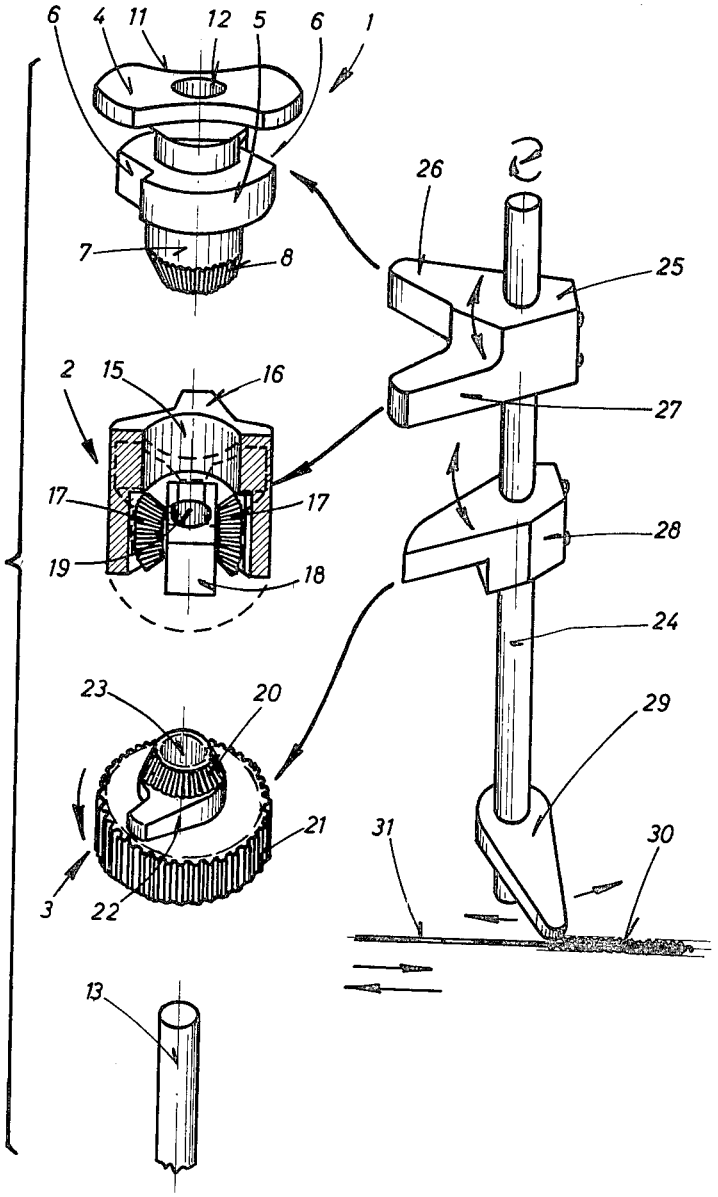
FIG. 1 is a perspective, exploded, and partly sectional view of the mechanism according to this invention.
Figure 2:
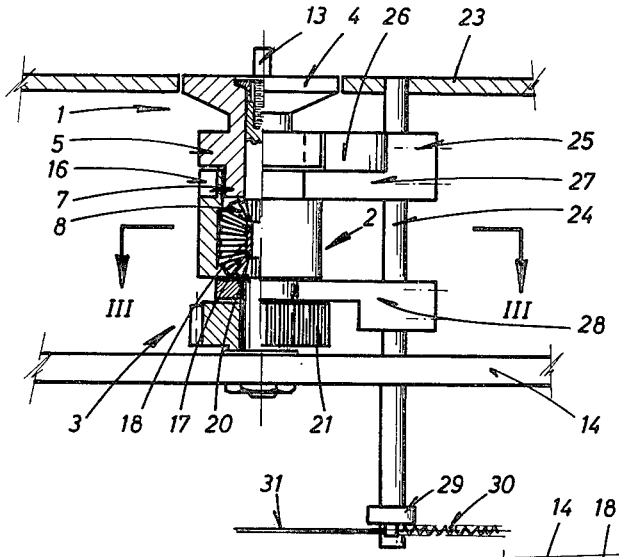
FIG. 2 is a partly sectional side view of the mechanism according to this invention.
Figure 3:
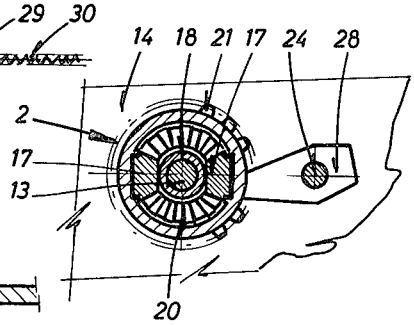
FIG. 3 is a section taken along line III—III of FIG. 2.

As shown in FIGS. 1–3 the system according to this invention basically comprises an output unit 1, a transmission unit 2 and a drive unit 3 all rotatable about a common drive axis A defined by a fixed mounting shaft 13 secured in one of two fixed support plates 14 and 23. The output unit 1 is constituted by a tubular member formed at one end with a sinker 4, at its center with a cam disk 5 having a pair of diametrically opposite V-shaped notches 6, and with a tubular extension 7 formed at its lower end as a bevel-type output gear 8. The sinker 4 cooperates with biconvex strips 9 (see FIG. 12) holding spindles or bobbins 10. The strips 9 are engaged in arcuate or part-circular recesses 11 formed in the sinker 4. All of the output unit 1 is formed with an axially throughgoing bore 12 through which passes the fixed shaft 13 onto whose upper end is secured a washer shown in FIG. 2 which axially secures all of the units 1–3 axially in place.

The transmission unit 2 is formed of a tubular body or member formed at one side with a cavity 15 in which is received the cylindrical extension 7 of the unit 1. At this end the unit 2 is of cruciform section, forming four recesses or stops between escape arms 16. Two idler transmission pinions 17 of the bevel-gear type are supported on shafts mounted on a central stand or block 18 inside the unit 2. A hole 19 though this block 18 receives the shaft 13.

The input or drive unit 3 is constituted by a bevel gear 20 that engages in the lower end of the unit 2, and a spur-type drive gear 21 that is continuously engaged by a toothed belt or continuously driven drive gear that is not illustrated. Between the gears 20 and 21 is a cam arm 22. In addition the drive unit 3 is formed with a cylindrical throughgoing bore 23 identical to the bores 12 and 19 and also fitted over the fixed shaft 13.

Figure 4:
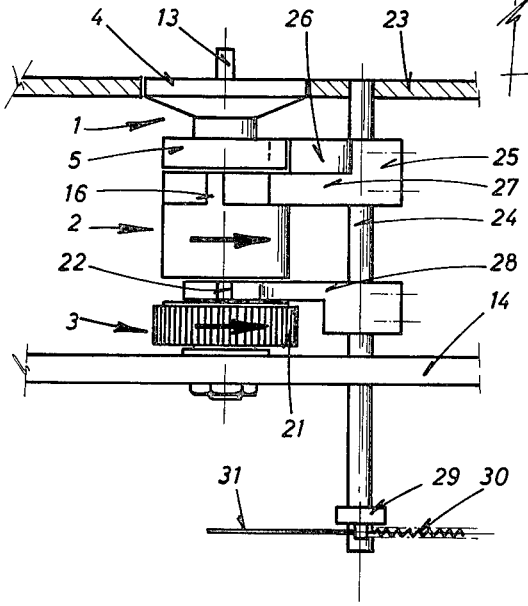
FIGS. 4 and 5 are views similar to FIG. 3 illustrating the mechanism in the stopping and racking positions, respectively.
Figure 5:
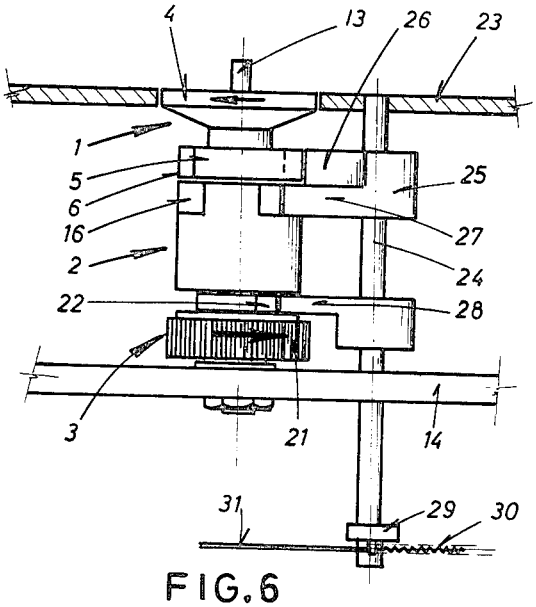
Figure 8:
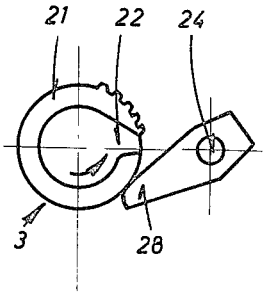
FIGS. 6, 7 and 8 are top views of the output member, transmission member, and drive member in the stopping position.
Figure 6:
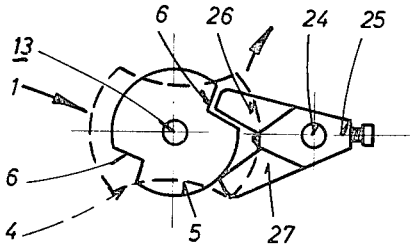
Figure 9:
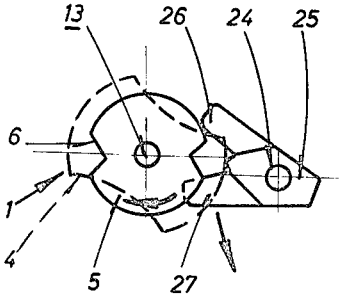
FIGS. 9, 10 and 11 are top views of the output member, transmission member and drive member in the racking position.
Figure 7:
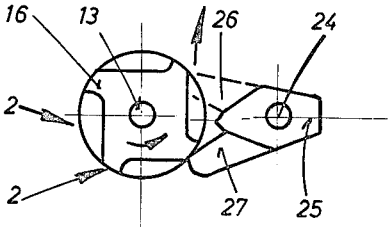
Figure 10:
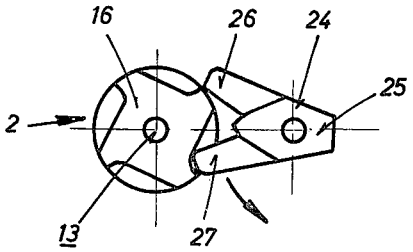
Figure 11:
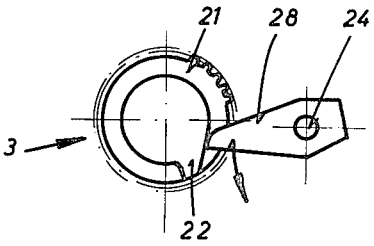
Figure 12:
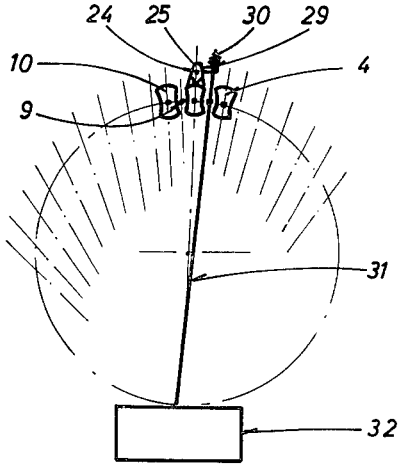
FIG. 12 is a top largely schematic view illustrating a machine embodying the mechanism according to this invention.

As shown in FIGS. 2, 4 and 5, the upper surface of the sinker 4 is planar and level with the upper surface of the upper fixed support plate 23. Extending between these plates 23 and 14 is an operator shaft 24 defining an operator axis A′ parallel to the axis A. An anchor or operator member 25 is fixed to this shaft 24 and has a pair of arms 26 and 27 which extend angularly away from the axis A′ at an angle of approximately 60° to each other, and which are axially spaced. The arm 26 can engage in either of the two recesses 6 and the arm 27 in any of the four recesses 16, but when the arm 26 is engaged in one of the recesses 6 the arm 27 will not be engageable in any of the recesses 16 and vice versa. Furthermore the shaft 24 is fixed to a release pawl 28 engageable with the release cam 22. An operating arm 29 has one end braced by a spring 30 urging it in the clockwise direction as seen from above and also engaged by a control rod 31 extending as shown in FIG. 12 to the jacquard control mechanism 32 for the automatic change of pattern in the shaping of lace by means of bobbins 10 for crossing of the yarns.

The gear 21 is always rotated in the same direction, counterclockwise as seen from above, as shown by the arrows in FIGS. 1, 4 and 5. During operation the arm 26 cooperates with the rim of the disk cam 5 whereas the arm 27 which is lower than the arm 26 is engageable with the projections or notches 16. The pawl 28 is engageable with the cam 22 between the gears 20 and 21. The two spider bevel gears 17 continuously mesh with the bevel gear 20 and with the bevel gear 8, and the gearing is such that a two-to-one transmission from the gear 21 to the element 4 is achievable.

During the standard operation of the machine, between displacement of the bobbins 10, the arrangement is in the stopping position shown in FIGS. 4 and 6–8. In this position the spring 30 is unopposed by the rod 31 so that the operator member 25 engages with its branch 26 against the rim of the disk 5 and therefore extends into one of the recesses 6. The other arm 27 will be at or spaced slightly radially outwardly from the periphery of the transmission member 2. Thus the output member 1 will be blocked from rotation in the clockwise direction but the transmission member 2 will be able to rotate readily in the counterclockwise direction, at an angular speed equal to half that of the drive unit 3. In this position the arm 28 will also be spaced outwardly from the cam 22.

For 180° displacement of the respective bobbins 10 the control rod 31 is briefly actuated to displace the shaft 24 angularly and put the various operating arms 26–28 into the racking position. This is shown in FIGS. 5 and 9–11. First of all the arm 26 is pulled out of the respective notch 6 whereas the arm 27 is pressed against the unit 2. Thus this arm 27 will engage in one of the recesses defined by the portions 16 and will prevent rotation of the unit 2. Since the arm 26 is no longer engaged in either of the recesses 6 it will therefore be possible for the drive unit 3 to rotate the output unit 1 through the gears 17. Clearly the direction of rotation between the elements 1 and 3 will be opposite and the angular velocity of the unit 1 will be equal to that of the unit 3. If the member 25 disengages the unit 2, the latter starts rotating in the same direction as unit 3 but at a half speed.

Normally the rod 31 only exerts a momentary or extremely short force on the arm 29 so that immediately after withdrawal of the arm 26 from one of the recesses 6 the spring 30 will again be effective to urge the arm 26 against the periphery of the cam 5. Pivoting of the shaft 24 will, however, be impossible until another notch 6 aligns with the arm 26, and meanwhile the arm 27 will be engaged with the recesses of the unit 2 and will be preventing it from rotating.

When one of the recesses 6 aligns with the end of the arm 26, however, this arm 26 will pivot under the force of the spring 30 back into the stopping position so as to arrest the unit 1 and simultaneously free the arm 27 from the unit 2. Thus the device is returned to the stopping position.

In case the spring force 30 is not alone capable of displacing the elements from the stopping to the blocking position, due to powerful pressing of the unit 2 tangentially against the end of the arm 27, the cam 22 serves to forcefully push the arm 28 radially outwardly at approximately the same time a recess 6 of the cam 5 aligns with the upper arm 26. Since the unit 3 rotates at twice the speed of the unit 2 the cam 22 need only have one lobe appropriately positioned to achieve this effect. Thus even if the force of the spring 30 is inadequate, the cam 22 will forceably displace the unit back into the stop position. Obviously if tension is maintained on the rod 31 the device will immediately be able to return to the racking position if desired.

The mechanism according to this invention operates with extremely good mechanical reliability. First of all there is no axial movement of the various units 1–3 so that operation can be very simple and sure. Furthermore it is possible to use relatively light material, even tough synthetic-resin material such as an ABS resin, to form the units 1–3 to minimize friction and operational noise. In addition the use of a separate release cam 22 insures that the mechanism will not remain hung-up, that is continuously orbit the respective bobbins 10 around and form a lengthy knot in the piece of lace being produced. The device will always return to the stopping position.

It will be understood that each of the elements described above, or two or more together, may also find a useful application in other types of mechanisms differing from the types described above.

While the invention has been illustrated and described as embodied in a backing mechanism for lacemaking machine, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A bobbin-racking mechanism for a jacquard machine, said mechanism comprising:

a support;

a drive gear rotatable on said support about a drive axis;

a transmission member rotatable on said support independent of said drive gear about said drive axis;

an output member connectable to a bobbin and rotatable on said support independent of said drive gear and transmission member about said drive axis;

an output gear fixed to said output member and spaced from said drive gear;

a transmission gear rotatable on said transmission member about a transmission axis transverse to said drive axis and meshing simultaneously with said drive gear and said output gear, whereby on rotation of said transmission member said transmission gear orbits about said drive axis;

operator means engageable with said members and displaceable between a stopping position preventing rotation of said output member and permitting rotation of said transmission member and a racking position permitting rotation of said output member and preventing rotation of said transmission member; and a cam member connected to said drive gear and engageable with said operator means for displacing the latter from said racking into said stopping position.

2. The mechanism defined in claim 1, wherein said operator means includes an operator shaft defining and pivotal about an operator axis generally parallel to said drive axis and having an output arm engageable with said output member and fixed on said operator shaft and a transmission arm engageable with said transmission member and fixed on said operator shaft.

3. The mechanism defined in claim 2, wherein said members are formed with respective output and transmission recesses in which the respective arms are engageable during stopping of the respective member.

4. The mechanism defined in claim 3; further comprising a spring urging said operator means into said stopping position.

5. The mechanism defined in claim 4, wherein said gears are all bevel gears.

6. A bobbin-racking mechanism for a jacquard machine, said mechanism comprising:

a support;

a drive gear rotatable on said support about a drive axis;

a transmission member rotatable on said support independent of said drive gear about said drive axis;

an output member connectable to a bobbin and rotatable on said support independent of said drive gear and transmission member about said drive axis;

an output gear fixed to said output member and spaced from said drive gear;

a transmission gear rotatable on said transmission member about a transmission axis transverse to said drive axis and meshing simultaneously with said drive gear and said output gear, whereby on rotation of said transmission member said transmission gear orbits about said drive axis; and operator means engageable with said members and displaceable between a stopping position preventing rotation of said output member and permitting rotation of said transmission member and a racking position permitting rotation of said output member and preventing rotation of said transmission member, said operator means including an operator shaft pivotal about an operator axis generally parallel to said drive axis and having an output arm engageable with said output member and fixed on said operator shaft and a transmission arm engageable with said transmission member and fixed on said operator shaft; and further comprising means including a cam on said drive gear and a reset arm on said operator shaft for displacing said operator means from said racking into said stopping position.

7. The mechanism defined in claim 4, wherein said output member is formed with two such output recesses substantially diametrically opposite each other relative to said drive axis.

8. The mechanism defined in claim 7, wherein said gearing has a two-to-one ratio from said drive gear to said output gear through said transmission gear.

9. The mechanism defined in claim 8, wherein said transmission member has four such transmission recesses.

10. The mechanism defined in claim 4, wherein said support includes a fixed shaft lying on said drive axis and rotatably carrying said drive gear, transmission member, and output member.

11. The mechanism defined in claim 10; further comprising means on said fixed shaft for securing said drive gear transmission member, and output member against axial movement on said fixed shaft.

12. The mechanism defined in claim 4, wherein a second such transmission gear is carried on said transmission member, said transmission member being tubular and enclosing said transmission gears.

* * * * *